US008459706B2

(12) United States Patent
Yoshino et al.

(10) Patent No.: US 8,459,706 B2
(45) Date of Patent: Jun. 11, 2013

(54) DOOR HANDLE APPARATUS FOR VEHICLE

(75) Inventors: Masaki Yoshino, Anjo (JP); Koichi Nagata, Chiryu (JP); Mizuya Sakamoto, Kariya (JP)

(73) Assignee: Aisin Seiki Kabushiki Kaisha, Kariya-Shi, Aichi-Ken (JP)

( * ) Notice: Subject to any disclaimer, the term of this patent is extended or adjusted under 35 U.S.C. 154(b) by 246 days.

(21) Appl. No.: 12/857,924

(22) Filed: Aug. 17, 2010

(65) Prior Publication Data

US 2011/0042973 A1 Feb. 24, 2011

(30) Foreign Application Priority Data

Aug. 18, 2009 (JP) ..... 2009-189115

(51) Int. Cl.
*E05B 3/00* (2006.01)
*E05C 19/06* (2006.01)

(52) U.S. Cl.
USPC ..... 292/336.3; 292/80; 292/DIG. 38

(58) Field of Classification Search
USPC ..... 292/80, 336.3, DIG. 38
See application file for complete search history.

(56) References Cited

U.S. PATENT DOCUMENTS

| | | | | |
|---|---|---|---|---|
| 6,363,577 | B1 * | 4/2002 | Spitzley | 292/336.3 |
| 6,910,303 | B1 * | 6/2005 | Mathofer | 49/503 |
| 6,964,439 | B2 * | 11/2005 | Nomura et al. | 292/336.3 |
| 7,344,168 | B2 * | 3/2008 | Matsubara et al. | 292/336.3 |
| 7,827,736 | B2 * | 11/2010 | Sunahara et al. | 49/503 |
| 7,971,913 | B2 * | 7/2011 | Sunahara et al. | 292/336.3 |
| 2002/0089194 | A1 * | 7/2002 | Nomura et al. | 292/336.3 |
| 2008/0047203 | A1 | 2/2008 | Sunahara et al. | |
| 2008/0088139 | A1 * | 4/2008 | Sunahara et al. | 292/336.3 |
| 2011/0042973 | A1 * | 2/2011 | Yoshino et al. | 292/336.3 |

FOREIGN PATENT DOCUMENTS

| | | | |
|---|---|---|---|
| JP | 2003-003696 | A | 1/2003 |
| JP | 2003-247356 | | 9/2003 |
| JP | 2006-037378 | A | 2/2006 |
| JP | 2007-002621 | A | 1/2007 |
| JP | 2008-013961 | A | 1/2008 |
| JP | 2008-050870 | A | 3/2008 |

OTHER PUBLICATIONS

Office Action issued by Japan Patent Office on Apr. 9, 2013 in corresponding Japanese Patent Application No. 2009-189115, and English language translation thereof.

* cited by examiner

*Primary Examiner* — Carlos Lugo
(74) *Attorney, Agent, or Firm* — Buchanan Ingersoll & Rooney PC

(57) ABSTRACT

A door handle apparatus for a vehicle, includes a frame, a handle, a rotational movement connecting portion integrally formed at one of the frame and the handle, a contact wall portion integrally formed at the other one of the frame and the handle and restricting a displacement of the handle towards one end portion thereof in a longitudinal direction thereof when contacting the rotational movement connecting portion, and a protruding portion integrally formed at the other one of the frame and the handle, being elastically deformable when press-contacting the rotational movement connecting portion to allow the handle to be slidably displaced towards the one end portion, elastically returning to an initial position where the slide displacement of the handle towards the other end portion in the longitudinal direction is restricted when the press-contact is cancelled, and rotatably supporting the rotational movement connecting portion in conjunction with the contact wall portion.

10 Claims, 8 Drawing Sheets

DOOR HANDLE APPARATUS FOR VEHICLE

CROSS REFERENCE TO RELATED APPLICATIONS

This application is based on and claims priority under 35 U.S.C. §119 to Japanese Patent Application 2009-189115, filed on Aug. 18, 2009, the entire content of which is incorporated herein by reference.

TECHNICAL FIELD

This disclosure generally relates to a door handle apparatus for a vehicle.

BACKGROUND

There exists a door handle apparatus for a vehicle including a frame, which is fixed at a door panel of a vehicle door, and a handle, which serves as a holding portion when the vehicle door is operated to open and which is rotatably supported relative to the frame, so that the door handle apparatus transmits an operation force for canceling a retention of the vehicle door to a door lock mechanism, which retains the vehicle door in a fully-closed state, in response to a rotational operation of the handle (e.g. JP2006-37378A, JP2007-2621A, JP2008-50870A). According to the door handle apparatus for the vehicle having the above-mentioned configuration, an additional supporting member or a bearing member (a fixing piece) is provided at the frame at a connecting portion between the frame and the handle in order to reduce a backlash of the handle (e.g. a backlash of the handle in a longitudinal direction thereof).

However, according to the door handle apparatus for the vehicle disclosed in, for example, JP2006-37378A, JP2007-2621A and JP2008-50870A, the additional supporting member and the like needs to be provided at the frame at the connecting portion between the frame and the handle. Accordingly, a number of components used for the door handle apparatus and manufacturing hours for manufacturing the door handle apparatus may be increased. Specifically, according to the door handle apparatus for the vehicle disclosed in JP2006-37378A and JP2007-2621A, a connecting member (e.g. a bolt and the like) needs to be provided in order to attach the additional supporting member to the frame. Accordingly, the number of components and the manufacturing hours may be further increased.

A need thus exists to provide a door handle apparatus for a vehicle which is not susceptible to the drawback mentioned above.

SUMMARY

According to an aspect of this disclosure, a door handle apparatus for a vehicle, includes a frame adapted to be fixed at a door panel of a vehicle door, a handle adapted so as to be supported by the frame while being freely rotatable relative to the frame, to serve as a holding portion when the vehicle door is operated to open, and so as to transmit an operation force for canceling a retention of the vehicle door to a door lock mechanism, which retains the vehicle door at a fully-closed state, in response to a rotational operation of the handle, a rotational movement connecting portion integrally formed at one of the frame and the handle and having a center line extending along a rotational axis of the handle, a contact wall portion integrally formed at the other one of the frame and the handle and restricting a displacement of the handle towards one end portion thereof in a longitudinal direction thereof in a manner where the contact wall portion contacts the rotational movement connecting portion in response to a slide movement of the handle towards the one end portion thereof in the longitudinal direction, and a protruding portion integrally formed either at the frame or the handle having the contact wall portion, being elastically deformable when the protruding portion press-contacts the rotational movement connecting portion in response to the slide movement of the handle towards the one end portion thereof in the longitudinal direction so as to allow the handle to be slidably displaced towards the one end portion thereof in the longitudinal direction, elastically returning to an initial position so as to restrict the slide displacement of the handle towards the other end portion thereof in the longitudinal direction when a press-contact against the rotational movement connecting portion is cancelled while the rotational movement connecting portion is positioned at a movement restriction position for restricting the displacement of the handle towards the one end portion thereof in the longitudinal direction by means of the contact wall portion, and supporting the rotational movement connecting portion in conjunction with the contact wall portion while allowing the rotational movement connecting portion to be freely rotatable relative to the contact wall portion and the protruding portion.

According to another aspect of this disclosure, a door handle apparatus for a vehicle, includes a frame adapted to be fixed at a door panel of a vehicle door, a handle adapted so as to be supported by the frame while being freely rotatable relative to the frame, to serve as a holding portion when the vehicle door is operated to open, and so as to transmit an operation force for canceling a retention of the vehicle door to a door lock mechanism, which retains the vehicle door at a fully-closed state, in response to a rotational operation of the handle, a rotational movement connecting portion integrally formed at one of the frame and the handle and having a center line extending along a rotational axis of the handle, a contact wall portion integrally formed at the other one of the frame and the handle and restricting a displacement of the handle towards one end portion thereof in a longitudinal direction thereof in a manner where the contact wall portion contacts the rotational movement connecting portion in response to a slide movement of the handle towards the one end portion thereof in the longitudinal direction, a protruding portion integrally formed either at the frame or the handle having the contact wall portion, being elastically deformable when the protruding portion press-contacts the rotational movement connecting portion in response to the slide movement of the handle towards the one end portion thereof in the longitudinal direction so as to allow the handle to be slidably displaced towards the one end portion thereof in the longitudinal direction, elastically returning to an initial position so as to restrict the slide displacement of the handle towards the other end portion thereof in the longitudinal direction when a press-contact against the rotational movement connecting portion is cancelled while the rotational movement connecting portion is positioned at a movement restriction position for restricting the displacement of the handle towards the one end portion thereof in the longitudinal direction by means of the contact wall portion, and supporting the rotational movement connecting portion in conjunction with the contact wall portion while allowing the rotational movement connecting portion to be freely rotatable relative to the contact wall portion and the protruding portion, a support pillar portion integrally formed either at the frame or the handle having the protruding portion and serving as a fulcrum of the protruding portion when being elastically deformed, and an operation input portion integrally formed either at the frame or the handle having the protruding portion and elastically deforming the protruding portion about the support pillar portion as the fulcrum in response to a press operation applied to the operation input portion.

BRIEF DESCRIPTION OF THE DRAWINGS

The foregoing and additional features and characteristics of this disclosure will become more apparent from the following detailed description considered with the reference to the accompanying drawings, wherein.

DETAILED DESCRIPTION

Figure 6:
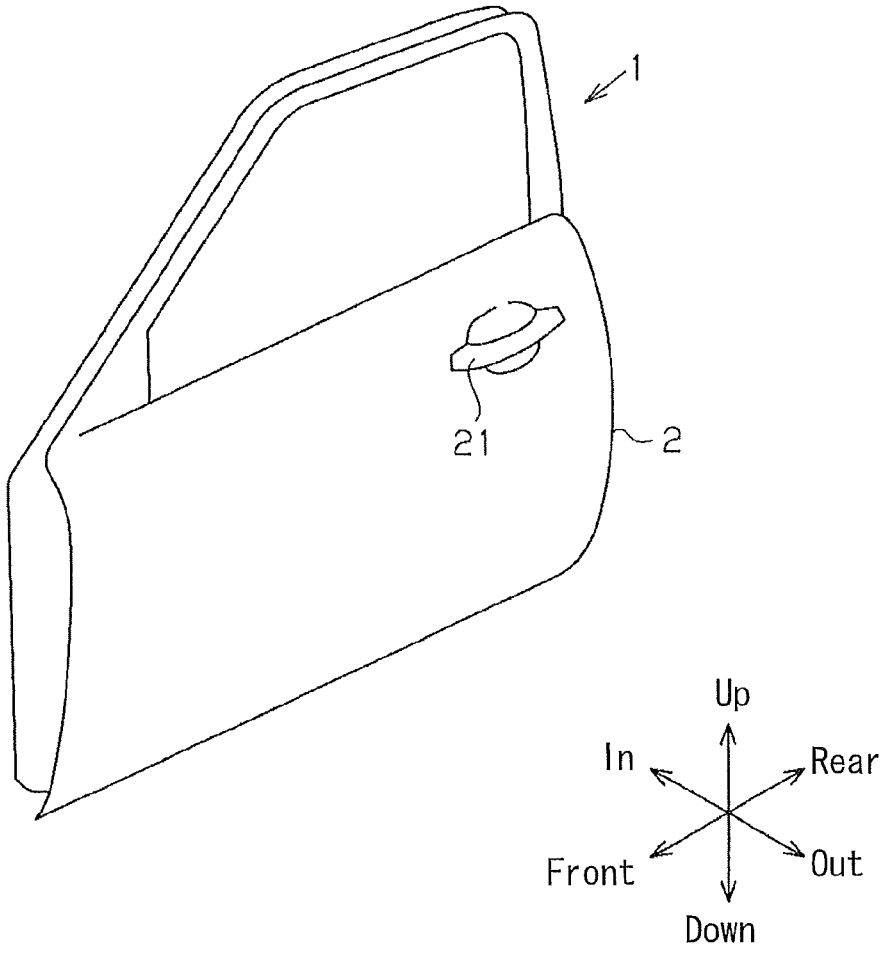
FIG. 6 is a perspective view illustrating a vehicle door.

An embodiment of a door handle apparatus for a vehicle will be described below with reference to the attached drawings. Directions indicated at each figure (i.e. a front-rear direction, an up-and-down direction and an inward-outward direction) correspond to directions centering on the vehicle. Illustrated in FIG. 6 is a perspective view of a vehicle door 1, which is provided at a side portion of the vehicle. As illustrated in FIG. 6, the vehicle door 1 includes a door outer panel 2 (a door panel), which defines an outer design (an exterior of the vehicle), and a handle 21, which is made of a resin material and which extends in the front-rear direction. The handle 21 is supported at the door outer panel 2 while being exposed to an outer side of the door outer panel 2. The handle 21 serves as a holding portion when the vehicle door 1 is operated to open. Furthermore, the handle 21 is mechanically connected to a door lock mechanism, which retains the vehicle door 1 in a fully-closed state. Accordingly, when the handle 21 is operated so as to be outwardly pulled, an operation force for canceling the retention of the vehicle door 1 in the fully-closed state is transmitted to the door lock mechanism.

Figure 1:
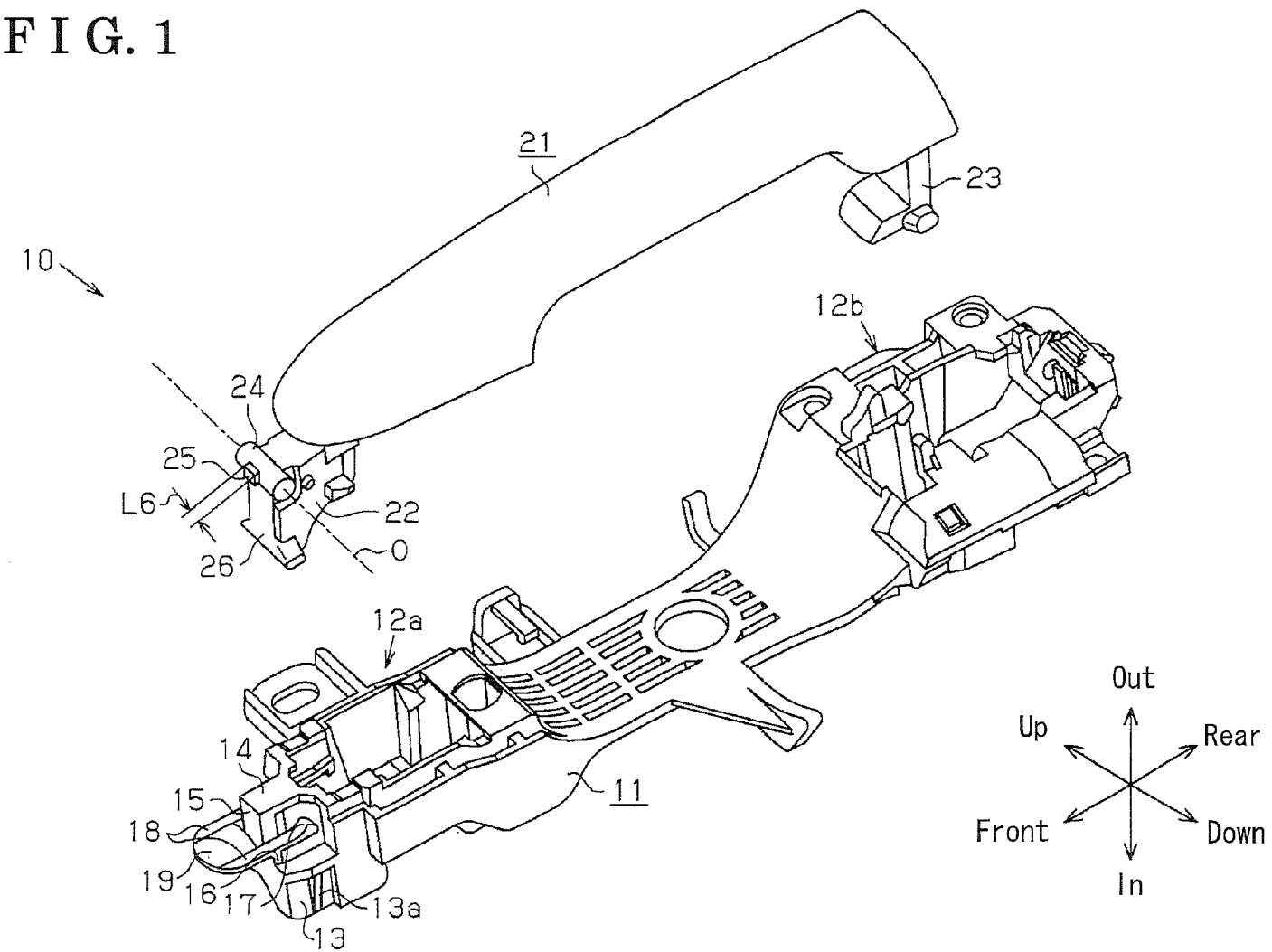
FIG. 1 is a perspective view schematically illustrating a door handle apparatus for a vehicle according to an embodiment.
Figure 2:
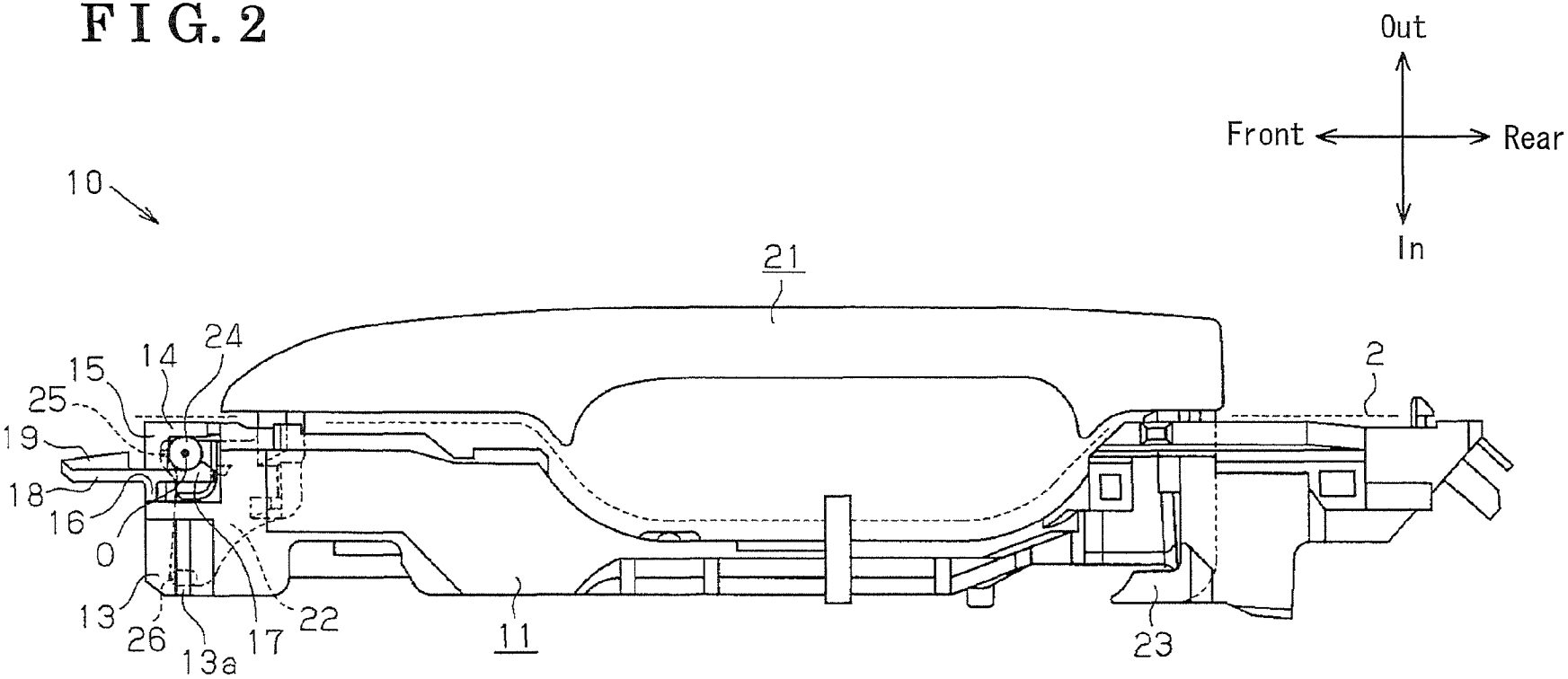
FIG. 2 is a side view schematically illustrating the door handle apparatus for the vehicle according to the embodiment.

Illustrated in FIG. 1 is an exploded perspective view illustrating a door handle apparatus 10 for the vehicle (which will be hereinafter referred to as a door handle apparatus 10) according to the embodiment. Illustrated in FIG. 2 is a plain view of the door handle apparatus 10 according to the embodiment. As illustrated in FIGS. 1 and 2, the door handle apparatus 10 includes a frame 11 and the handle 21. The frame 11, which is made of a resin material, is configured so as to extend in the front-rear direction and is fixed at an inner surface of the door outer panel 2.

A first opening portion 12*a* is formed at a front end portion of the frame 11 so as to open in the inward-outward direction (i.e. in a vehicle width direction). Furthermore, a second opening portion 12*b* is formed at a rear end portion of the frame 11 so as to open in the inward-outward direction (i.e. in the vehicle width direction). An entire front portion of the frame 11 including the first opening portion 12*a* is formed so as to recess and protrude only in one direction towards the handle 21 (i.e. in the inward-outward direction). An arm portion 22 is formed at a front end portion of the handle 21 so as to protrude in the inward direction (towards a vehicle interior) towards the first opening portion 12*a* from a surface of the handle 21 facing the frame 11. Furthermore, a leg portion 23 is formed at a rear end portion of the handle 21 so as to protrude in the inward direction (towards the vehicle interior) towards the second opening portion 12*b* from the surface of the handle 21 facing the frame 11. The handle 21 is connected to the frame 21 in a manner where the arm portion 22 and the leg portion 23, which penetrate the door outer panel 2 from the outer side of the vehicle, are inserted into the first opening portion 12*a* and the second opening portion 12*b*, respectively, so that the door outer panel 2 is positioned between the handle 21 and the frame 11. As a result, the handle 21 is supported by the frame 11 while allowing the handle 21 (i.e. a portion of the handle 21 having the leg portion 23) to pivot about a front portion of the handle 21 (i.e. a portion of the handle 21 having the arm portion 22) as a fulcrum. The handle 21 is connected to the door lock mechanism at the leg portion 23, so that the door lock mechanism is actuated in conjunction with the operation of the handle 21. More specifically, when the handle 21 is pivotally operated so that the leg portion 23 is outwardly pulled, the door lock mechanism is unlocked (i.e. the retention of the vehicle door 1 by the door lock mechanism is cancelled).

Figure 3:
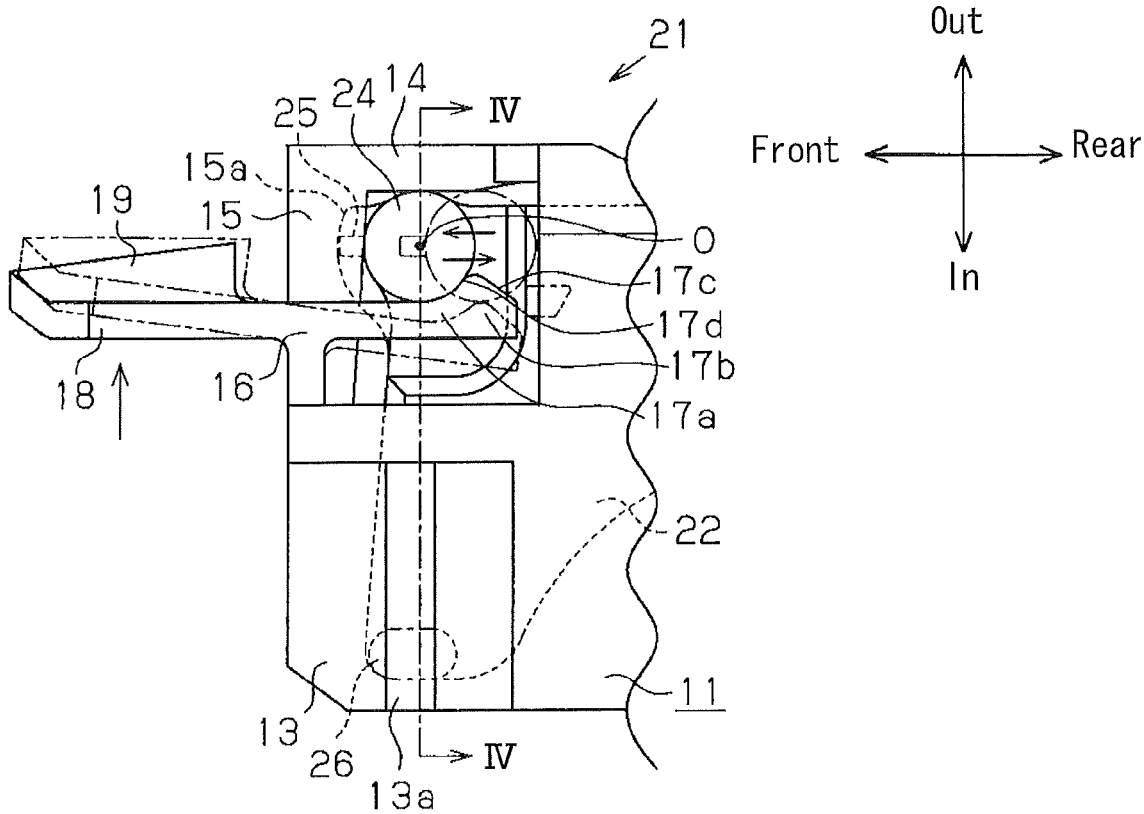
FIG. 3 is a side view focusing on a connecting portion between a frame and a handle of the door handle apparatus for the vehicle illustrated in FIG. 2.
Figure 4:
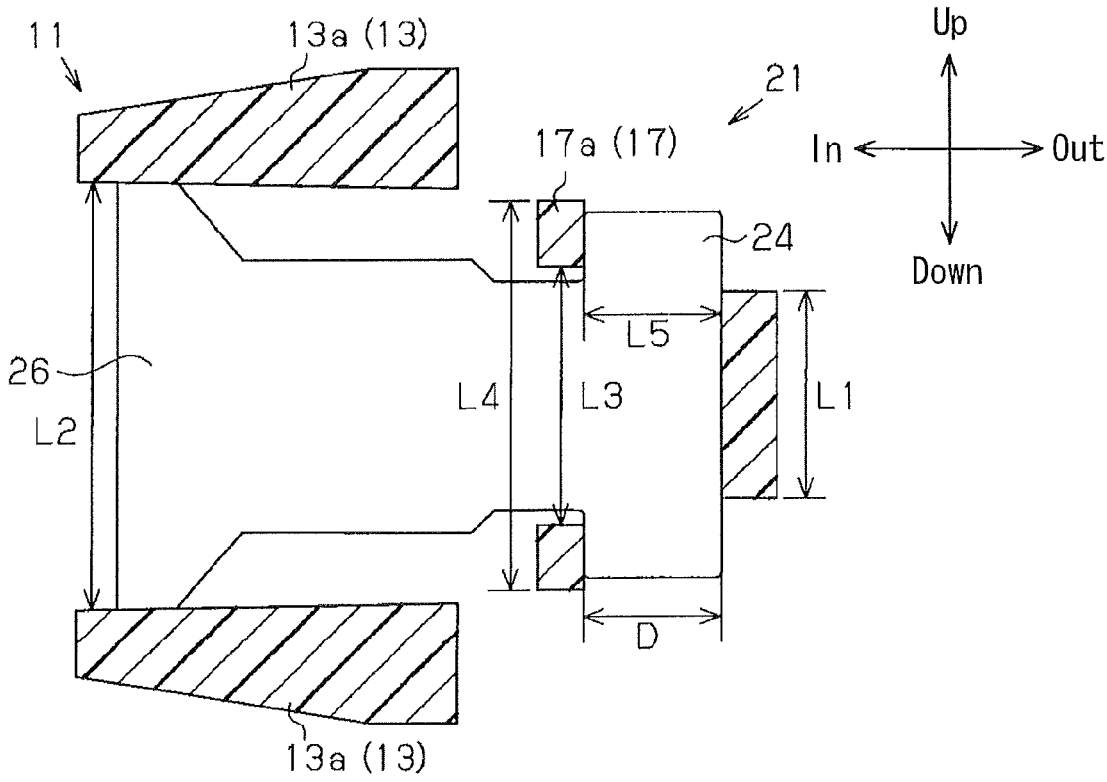
FIG. 4 is a cross-sectional diagram of the connecting portion taken along line IV-IV in FIG. 3.

A connecting structure between the frame 11 and the handle 21 at the front portions thereof will be described below in accordance also with FIGS. 3 and 4. Illustrated in FIG. 3 is an enlarged diagram of a front portion of the door handle apparatus 10 in FIG. 2. Illustrated in FIG. 4 is a cross-sectional diagram taken along line IV-IV in FIG. 3. In the explanation of the connecting structure in accordance with FIGS. 3 and 4, the front-rear direction is also referred to as a longitudinal direction of the handle 21 and the like.

As illustrated in FIG. 1, the first opening portion 12*a* is configured so as to open also to the front. The frame 11 includes a framing portion 13, which is formed in a substantially U-shape. More specifically, the framing portion 13 is formed at the frame 11 so as to continuously extend from a front end surface of the opening portion 12*a* positioned closer to the vehicle interior and then to further protrude towards the front. The framing portion 13 includes a rib 13*a* for increasing a strength thereof at an intermediate portion of the framing portion 13 in the front-rear direction. More specifically, the frame 11 includes an upper framing portion 13 and a lower framing portion 13, which are provided with an upper rib 13*a* and a lower rib 13*a* formed so as to outwardly protrude in the upward direction and in the downward direction from an upper end surface and a lower end surface of the intermediate portions of the upper and lower framing portions 13, respectively. Furthermore, the frame 11 includes a wall portion 14, which is formed in a substantially Y-shaped plate. More specifically, the wall portion 14 is formed at the frame 11 so as to continuously extend from a front end portion of the opening portion 12*a* positioned closer to the exterior of the vehicle and further protrude to the front. The wall portion 14 is connected to the opening portion 12*a* at both split end portions of the Y-shape thereof. Accordingly, a width L1 of the wall portion 14 at a front end portion thereof in the up-and-down direction is set to be shorter than an opening width L2 of the first opening portion 12*a* in the up-and-down direction (see FIG. 4). The opening width L2 of the first opening portion 12*a* corresponds to a distance between the upper and lower ribs 13*a* (the upper and lower framing portions 13). Furthermore, the frame 11 includes a contact wall portion 15, which is formed in a plate shape so as to extend in the inward-outward direction and which connects a front end portions of the framing portions 13 on the one hand and a front end portion of the wall portion 14 on the other hand. The contact wall portion 15 is formed so that a width thereof in the up-and-down direction corresponds to the width L1 of the wall portion 14. Furthermore, the contact wall portion 15 includes a groove portion 15*a*, which is formed in a substantially quadrangle so as to recess to the front from a rear end surface thereof (see FIG. 3 and FIG. 5B). Additionally, the groove portion 15*a* is formed so as to extend to the vehicle interior along the longitudinal direction of the contact wall portion 15, so that the groove portion 15*a* communicates with the vehicle interior.

As illustrated in FIGS. 3 and 4, the frame 11 includes a support pillar portion 16 and a protruding portion 17. More specifically, the frame 11 includes an upper support pillar portion 16 and a lower support pillar portion 16, which are arranged so as to keep a distance therebetween in the up-and-down direction, and an upper protruding portion 17 and a lower protruding portion 17, which are arranged so as to keep a distance therebetween in the up-and-down direction, so that the contact wall portion 15 is positioned between the upper support pillar portion 16 and the upper protruding portion 17 on the one hand and the lower support pillar portion 16 and the lower protruding portion 17 on the other hand. Each of the upper and lower support pillar portions 16 is formed so as to stand on an end surface of the framing portion 13 positioned closer to the exterior of the vehicle along an front end portion of the contact wall portion 15. Each of the upper and lower protruding portions 17 is formed in an elongated shape so that the protruding portion 17 continuously extend in the rearward direction from an end portion of each of the upper and lower support pillar portions 16 positioned closer to the exterior of the vehicle. Each of the protruding portions 17 integrally includes an arm portion 17*a* and an engagement pawl 17*b* as a unit. The arm portion 17*a* is supported by the corresponding support pillar portion 16 at the end portion thereof in a cantilever manner and extends in the front-rear direction. The engagement pawl 17*b* is formed so as to integrally protrude in a direction towards the vehicle exterior from a rear end portion of the arm portion 17*a* towards the wall portion 14. Each of the protruding portions 17 is configured so that the arm portion 17*a* is elastically deformable (bent) in a clockwise direction or in a counterclockwise direction in FIG. 3 about the support pillar portion 16 as a fulcrum. Additionally, a rear end surface of the engagement pawl 17*b* is formed so that a level thereof gradually inclines from a rear end portion thereof towards a front end portion thereof in the direction towards the vehicle exterior, so that the rear end surface of the engagement pawl 17*b* forms an inclined surface 17*c*. On the other hand, a front end surface of the engagement pawl 17*b* curves from the front end portion thereof to the rear end portion thereof in the direction towards the vehicle exterior, so that the front end surface of the engagement pawl 17*b* forms an arc surface 17*d*.

The frame 11 further includes an operation input portion 18, which is formed in an elongated shape and which continuously extends from the end portion of the support pillar portion 16 positioned closer to the exterior of the vehicle towards the front. More specifically, the frame 11 includes an upper operation input portion 18 and a lower operation input portion 18. Accordingly, the upper and lower operation input portions 18 are also supported by the upper and lower support pillar portions 16 in the cantilever manner, respectively, so that the upper and lower operation input portions 18 are allowed to be elastically deformed (bent) in the clockwise direction or in the counterclockwise direction in FIG. 3 about the corresponding support pillar portions 16 as the fulcrum.

The protruding portion 17 (the upper and lower protruding portions 17) and the operation input portion 18 (the upper and lower operation input portions 18) are arranged so as to extend in a line from the support pillar portion 16 (the upper and lower support pillar portions 16) towards the front and towards the rear, respectively. Specifically, the upper and lower protruding portions 17 and the upper and lower operation input portion 18 are configured so that the upper and lower protruding portions 17 are elastically deformed in conjunction with the elastic deformation (bend) of the upper and lower operation input portions 18 about the upper and lower support pillar portions 16 as the fulcrums, respectively. Furthermore, front end portions of the upper and lower operation input portions 18 in the up-and-down direction are bridged by a connecting wall 19, which is formed in a plate shape extending in the up-and-down direction. The connecting wall 19 is formed in an arc shape so that an intermediate portion thereof protrudes towards the exterior of the vehicle relative to an upper end portion and a lower end portion of the connecting wall 19. The operation input portions 18 (and the protruding portions 17) are elastically deformed as a unit in the clockwise direction as indicated by a chain-double-dotted line in FIG. 3 when, for example, the connecting wall 19 is pushed towards the exterior of the vehicle. In this case, the protruding portions 17, which are deformed in conjunction with the corresponding operation input portions 18, are elastically deformed so that the rear end portions of the protruding portions 17 are displaced away from the wall portion 14.

A distance L3 between surfaces of the upper protruding portion 17 and the lower protruding portion 17 facing each other (and a distance between surfaces of the upper operation input portion 18 and the lower operation input portion 18 facing each other) is set to be greater than the width L1. On the other hand, a distance L4 between surfaces of the upper protruding portion 17 and the lower protruding portion 17 facing opposite to each other (and a distance between surfaces of the upper operation input portion 18 and the lower operation input portion 18 facing opposite to each other) is set to be shorter than the opening width L2 (see FIG. 4). As described above, because the entire front portion of the frame 11 is formed so as to recess and protrude only in the inward-outward direction, the framing portion 13, the wall portion 14, the protruding portions 17 and the operation input portions 18 are arranged so that positions thereof are not overlapped with each other in the up-and-down direction.

As illustrated in FIG. 1, the handle 21 includes a rotational movement connecting portion 24, which is formed in a column shape whose center line O extends in the up-and-down direction and which is formed at a front end portion of the arm portion 22 positioned closer to the exterior of the vehicle. The rotational movement connecting portion 24 serves as a rotational axis of the handle 21, which is supported by the frame 11, so that the rotational axis corresponds to the center line O. Furthermore, a diameter D of the rotational movement connecting portion 24 is set to be twice as large as an inner diameter of the arc surface 17*d*, and is set to correspond to an isolation distance L5 between the wall portion 14 and the arm portion 17*a* (the protruding portion 17) in the inward-outward direction (see FIG. 4). As illustrated in FIG. 3, in a state where the rotational movement connecting portion 24 is surrounded by the wall portion 14, the contact wall portion 15 and the arm portions 17*a* (the protruding portions 17) so that an outer circumferential surface of the rotational movement connecting portion 24 contacts surfaces of the respective wall portion 14, the contact wall portion 15 and the arm portions 17*a* facing the rotational movement connecting portion 24, an outer circumferential surface of each of end portions of the rotational movement connecting portion 24 slidably contacts the corresponding arc surface 17*d*. Accordingly, a positional displacement of the rotational movement connecting portion 24 in the inward-outward direction (i.e. the vehicle width direction, in a protruding direction of the engagement pawl 17*b*) is avoided because the rotational movement connecting portion 24 contacts the opposing surfaces of the respective wall portion 14 and the arm portions 17*a* (the protruding portions 17). Furthermore, a positional displacement of the rotational movement connecting portion 24 in the front-rear direction is avoided because the rotational movement connecting portion 24 contacts the contact wall portion 15 and the inclined surfaces 17*c*. The handle 21 is supported by the frame 11 so as to be rotatable about the rotational movement connecting portion 24.

As described above, the upper protruding portion 17 and the lower protruding portion 17 are formed so as to be elastically deformable about the corresponding support pillar portions 16 as the fulcrum. Therefore, in a case where the rotational movement connecting portion 24 is slidably displaced in the forward direction (i.e. towards one end portion of the handle 21 in the longitudinal direction thereof) from the first opening portion 12*a* at a position closer to an opening defined by the protruding portions 17 and the wall portion 14 and rearwardly of the protruding portions 17, the protruding portions 17, which press-contact with outer circumferential surface of the rotational movement connecting portion 24 at the both end portions thereof at the inclined surfaces 17*c*, are elastically deformed in the clockwise direction about the corresponding support pillar portions 16 as the fulcrums, as illustrated by a chain-double-dotted line in FIG. 3, thereby allowing the displacement of the rotational movement connecting portion 24. Then, when the rotational movement connecting portion 24 is further moved in the forward direction so that an outer circumferential intermediate portion of the rotational movement connecting portion 24 contacts the contact wall portion 15, the displacement of the rotational movement connecting portion 24 is restricted. Furthermore, the protruding portions 17, whose inclined surfaces 17*c* are released from a pressure-contact with the rotational movement connecting portion 24, elastically return to an initial position and restrict the displacement of the rotational movement connecting portion 24 in the rearward direction by means of the engagement pawls 17*b*.

The handle 21 includes a projection 25, which is formed in a block shape so as to project in the forward direction from the outer circumferential surface of the intermediate portion of the rotational movement connecting portion 24 in the longitudinal direction thereof (i.e. the intermediate portion of the rotational movement connecting portion 24 in the up-and-down direction). A width L6 of the projection 25 in the up-and-down direction (see FIG. 1) is set to have the same width as a width L7 of the groove portion 15*a* in the up-and-down direction (see FIG. 5B). In the case where the displacement of the rotational movement connecting portion 24 (the handle 21) in the forward-rearward direction is restricted in the above-mentioned manner, the projection 25 is engaged with the groove portion 15*a*. Accordingly, the displacement of the rotational movement connecting portion 24 (the handle 21) in the up-and-down direction is restricted while the rotational movement connecting portion 24 (the handle 21) is allowed to freely rotate relative to the frame 11.

Furthermore, the handle 21 includes a contact piece 26, which is formed in a plate shape so as to protrude towards the vehicle interior from the outer circumferential surface of the rotational movement connecting portion 24 at an angular position thereof facing the vehicle interior. As illustrated in FIG. 4, a width of an end portion of the contact piece 26 positioned closer to the vehicle interior is enlarged in the up-and-down direction, so that the end portion of the contact piece 26 contacts inner wall surfaces of the respective framing portions 13, which face the contact piece 26 in the up-and-down direction. Accordingly, the positional displacement of the handle 21 relative to the frame 11 in the up-and-down direction is also restricted because of the contact between the contact piece 26 and the framing portions 13.

Figure 5A:
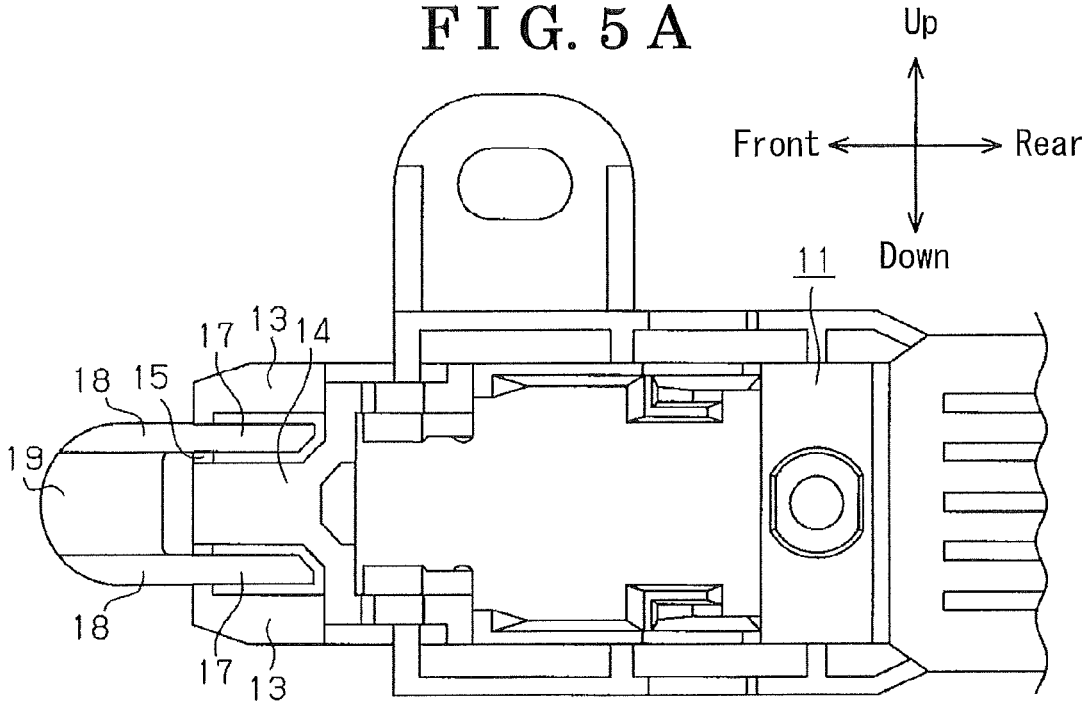
FIG. 5A is a plain view illustrating an end portion of the frame serving as a rotational center of the handle.
Figure 5B:
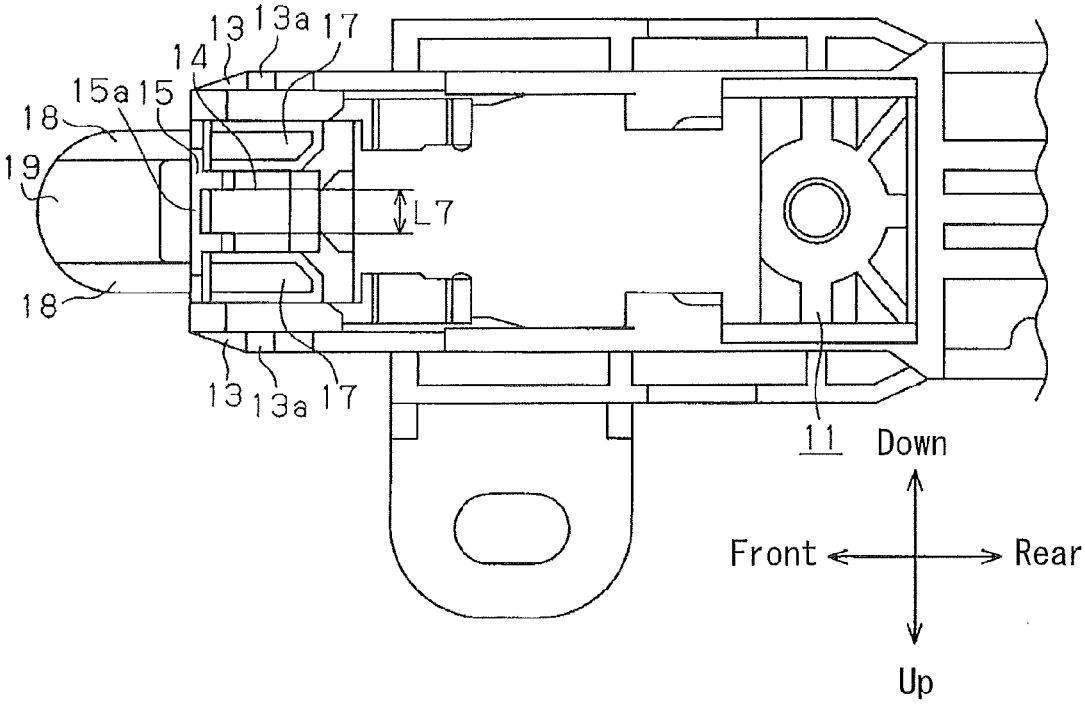
FIG. 5B is a bottom view illustrating the end portion of the frame serving as the rotational center.

Illustrated in FIGS. 5A and 5B are elevation diagrams of the front end portion of the frame 11 when being viewed from the vehicle exterior and the vehicle interior, respectively. As illustrated in FIGS. 5A and 5B, the front end portion of the frame 11 is formed so as to recess and protrude only in the inward-outward direction. Accordingly, in a case where the frame 11 is formed by molding, the frame 11 may be formed by using a pair of dies (upper and lower dies), which are formed so as to open in one direction corresponding to the inward-outward direction when mating together.

An attachment of the handle 21 to the frame 11 will be described below. Firstly, the arm portion 22 and the leg portion 23 of the handle 21 are inserted into the first and second opening portions 12*a* and 12*b*, respectively, so that the rotational movement connecting portion 24 is positioned between the wall portion 14 and the protruding portion 17 as illustrated in FIG. 3. Then, the rotational movement connecting portion 24 is slidably moved in the forward direction (i.e. towards one end portion of the handle 21 in the longitudinal direction thereof). Accordingly, the rotational movement connecting portion 24 press-contacts the inclined surfaces 17*c* of the corresponding protruding portions 17. While the rotational movement connecting portion 24 press-contacts the inclined surfaces 17*c*, the protruding portions 17 are allowed to elastically deform in the clockwise direction about the support pillar portions 16 as the fulcrums, respectively, as illustrated by the chain-double-dotted line in FIG. 3, so that the rotational movement connecting portion 24 is allowed to be displaced in the forward direction.

When the rotational movement connecting portion 24 contacts the contact wall 15, the press-contact between the protruding portions 17 (the upper and lower protruding portions 17) on the one hand and the rotational movement connecting portion 24 on the other hand is cleared, so that the protruding portions 17 elastically return to the initial positions so as to restrict the slide displacement of the rotational movement connecting portion 24 in the rearward direction. Accordingly, the rotational movement connecting portion 24, whose outer circumferential surface contacts the opposing surfaces of the wall portion 14, the contact wall portion 15 and the arm portions 17*a* (the protruding portions 17), is blocked by the arc surfaces 17*d* so as not to be disengaged from the space defined by the wall portion 14, the contact wall portion 15 and the arm portions 17*a* in the rearward direction, while the rotational movement connecting portion 24 slidably contacts the arc surfaces 17*d*. As a result, the handle 21 is supported by the frame 11 at the rotational movement connecting portion 24, while allowing the rotational movement connecting portion 24 to be freely rotatable relative to the frame 11.

In the case where the handle 21 and the frame 11 are assembled, the projection 25 of the handle 21 is engaged with the groove portion 15*a* and the contact piece 26 of the handle 21 contacts the framing portion 13, so that the positional displacement of the handle 21 in the up-and-down direction relative to the frame 11 is avoided.

A detachment of the handle 21, which is assembled at the frame 11, from the frame 11 will be described below. Firstly, the connecting wall 19 is pressed towards the vehicle exterior from an inner side of the door outer panel 2 by a finger of an operator or by means of a tool in order to detach the handle 21 from the frame 11. Accordingly, the protruding portions 17 (the upper protruding portion 17 and the lower protruding portion 17) are elastically deformed in conjunction with the corresponding operation input portions 18 (the upper operation input portion 18 and the lower operation input portion 18) in the clockwise direction about the corresponding support pillar portions 16 as the fulcrums, as indicated by the chain-double-dotted line in FIG. 3. As a result, an opening defined by the wall portion 14 and the protruding portions 17 is enlarged, so that the rotational movement connecting portion 24 is allowed to be slidably moved in the rearward direction. Therefore, when the handle 21 is slidably displaced in the rearward direction relative to the frame 11 while the above-mentioned state is established, the handle 21 is removable from the frame 11. Additionally, when the pressing force applied to the connecting wall 19 is released, the operation input portions 18 (the upper operation input portion 18 and the lower operation input portion 18) and the corresponding protruding portions 17 (the upper protruding portion 17 and the lower protruding portion 17) are both elastically returned to the respective initial positions (see positions thereof indicated by a solid line in FIG. 3).

According to the embodiment, the following advantages and merits may be achieved. Firstly, according to the embodiment, the frame 11 and the handle 21 are configured so that the protruding portions 17, which press-contact with the rotational movement connecting portion 24, are elastically deformed in the inward direction in response to the displacement of the rotational movement connecting portion 24 in the forward direction so as to allow the handle 21 to be further slidably moved in the forward direction in order to assemble the handle 21 to the frame 11. Then, the protruding portions 17 elastically return to a displacement restriction position for restricting the displacement of the handle 21 in the rearward direction in conjunction with the contact wall portion 15 when the protruding portions 17 are released from the press-contact with the rotational movement connecting portion 24. Accordingly, the rotational movement connecting portion 24 is supported by the contact wall portion 15 and the protruding portions 17 while allowing the rotational movement connecting portion 24 to be freely movable relative to the contact wall portion 15 and the protruding portions 17. In other words, the handle 21 is easily assembled to the frame 11 only by slidably moving the handle 21 in the forward direction. Furthermore, once the handle 21 is assembled to the frame 11, the slide displacement of the handle 21 in the rearward direction and in other direction(s) is avoided by the wall portion 14, the contact wall portion 15 and the protruding portions 17. Accordingly, the positional displacement of the handle 21 in the forward-rearward direction may be avoided. Additionally, because the rotational movement connecting portion 24 is integrally formed at the handle 21 as a unit, a number of components used for the door handle apparatus 10 and manufacturing hours for manufacturing the door handle apparatus 10 may be reduced, which may further result in reduction in manufacturing costs.

Secondly, the handle 21 is easily detached from the frame 11 by a simple operation of pressing the operation input portions 18 in the outward direction, because the protruding portions 17 are elastically deformed in response to the pressing operation to the corresponding operation input portions 18 so as to cancel the slide displacement restriction on the handle 21 in the rearward direction.

Thirdly, according to the embodiment, the end portion of the frame 11 serving as a rotational center of the handle 21 is formed so as to recess and protrude only in the width direction. Therefore, for example, in the case where the frame 11 is formed by molding, the frame 11 may be produced by using only the pair of dies (the upper die and the lower die), which are formed so as to open in one direction when mating together. Accordingly, a shape of the dies may be simplified, which may further result in the reduction in the manufacturing costs.

Fourthly, according to the embodiment, the projection 25, which is provided at the outer circumferential portion of the rotational movement connecting portion 24 so as to protrude therefrom, is formed so as to engage with the frame 11. While the projection 25 is engaged with the frame 11, the positional displacement of the rotational movement connecting portion 24 in the up-and-down direction is restricted. Accordingly, the positional displacement of the handle 21 in the width direction is avoided in the immediate vicinity of the rotational movement connecting portion 24.

Fifthly, according to the embodiment, each of the protruding portions 17 has a simple configuration (a so-called cantilever configuration) in which the corresponding arm portion 17*a* and the corresponding engagement pawl 17*b* are integrally formed at the protruding portion 17. Sixthly, according to the embodiment, the connecting wall 19 bridges the font end portions of the respective upper and lower operation input portions 18 in the up-and-down direction, so that the protruding portions 17, which are operated in conjunction with the corresponding operation input portions 18 in response to the press operation to the connecting wall 19, become elastically deformable so as to enlarge the opening defined between the wall portion 14 and the protruding portions 17 and formed behind the rotational operation connecting portion 24. As a result, the handle 21 may be smoothly detached from the frame 11.

Seventhly, according to the embodiment, the positional displacement of the handle 21 in the vehicle width direction (i.e. in the protruding direction of the engagement pawls 17*b*) may be avoided by means of the rotational movement connecting portion 24 in cooperation with the wall portion 14 and the arm portions 17*a*.

[Other Embodiment]

Figure 7A:
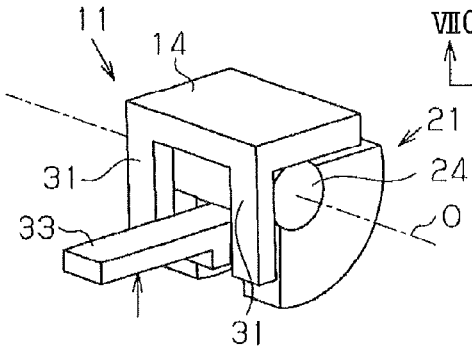
FIG. 7A is a perspective view illustrating a first modified example of the door handle apparatus for the vehicle.
Figure 7B:
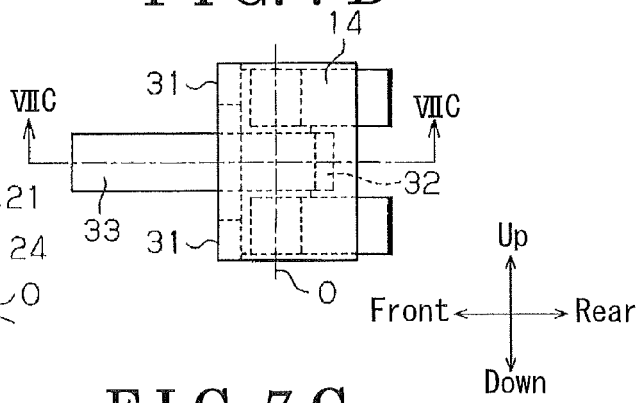
FIG. 7B is a plain view illustrating the first modified example of the door handle apparatus for the vehicle.
Figure 7B:
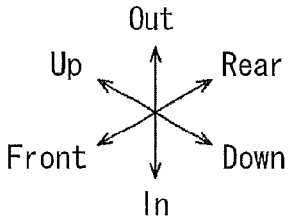
Figure 7C:
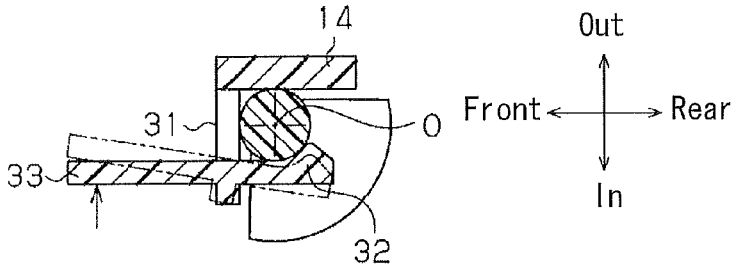
FIG. 7C is a cross-sectional diagram taken along line VIIC-VIIC in FIG. 7B.

The above-mentioned door handle apparatus may be modified as follow. As illustrated in FIGS. 7A, 7B and 7C, a pair of contact wall portions 31 may be provided at the frame 11 instead of the contact wall portion 15. The contact portions 31 are configured so as to contact the outer circumferential surfaces of both end portions of the rotational movement connecting portion 24, respectively, in order to restrict the displacement of the rotational movement connecting portion 24 in the forward direction. A protruding portion 32 may be provided at the frame 11 instead of the protruding portions 17. The protruding portion 32 is configured so as to slidably contact the outer circumferential surface of the rotational movement connecting portion 24 at the intermediate portion thereof in order to restrict the displacement of the rotational movement connecting portion 24 in the rearward direction. Furthermore, an operation input portion 33 may be provided at the frame 11 instead of the operation input portions 18. The operation input portion 33 is formed so as to extend in alignment with the protruding portion 32 so as to be operated in conjunction with the protruding portion 32. According to the above-mentioned modified embodiment, because plural protruding portions 32 do not need to be provided at the handle 21, i.e. only one protruding portion 32 needs to be provided at the handle 21, a shape of the handle 21 may be simplified.

Figure 8A:
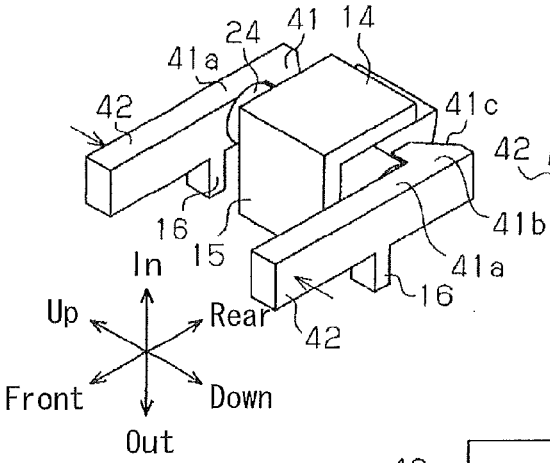
FIG. 8A is a perspective view illustrating a second modified example of the door handle apparatus for the vehicle.
Figure 8B:
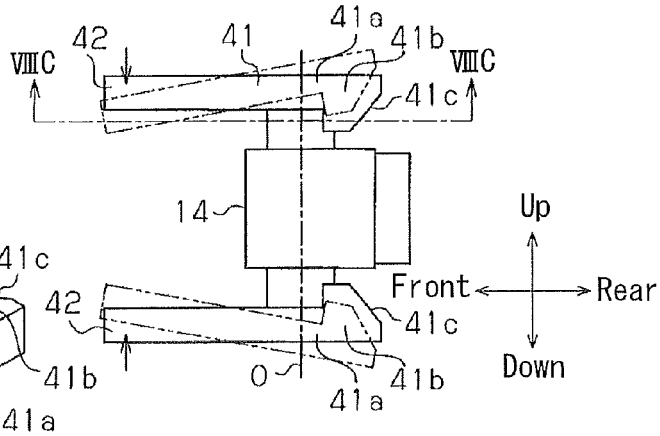
FIG. 8B is a plain view illustrating the second modified example of the door handle apparatus for the vehicle.
Figure 8C:
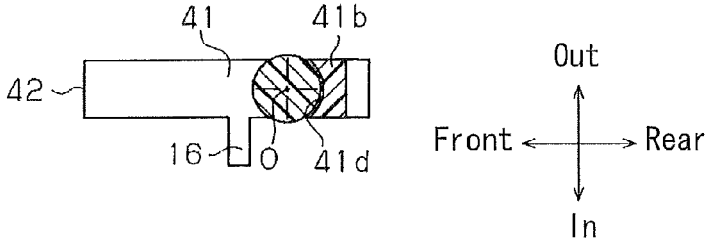
FIG. 8C is a cross-sectional diagram taken along line VIIIC-VIIIC in FIG. 8B.

As illustrated in FIGS. 8A, 8B and 8C, a pair of protruding portions 41 may be provided at the frame 11 instead of the projecting portions 17. The protruding portions 41 are formed so as to sandwich the rotational movement connecting portion 24 in a direction extending along the center line O (i.e. in the up-and-down direction). Furthermore, each of the protruding portions 41 integrally includes an arm portion 41*a* and an engagement pawl 41*b*. The arm portion 41*a* is formed so as to extend in the front-rear direction while being supported by the corresponding support pillar portion 16 in the cantilever manner. The engagement pawls 41*b* are formed at rear end portions of the arm portions 41*a*, respectively, so that the engagement pawls 41*b* protrude to face to each other in the up-and-down direction. Furthermore, each of the protruding portions 41 is formed so that the arm portion 41*b*, which is supported by the support pillar portion 16, is allowed to be elastically deformable (bend) in a clockwise direction or in a counter-clockwise direction in FIG. 8B about the support pillar portion 16 as the fulcrum. Additionally, an inclined surface 41*c* is formed at a rear end surface of each of the engagement pawls 41*b*, so that the rear end surface inclines in the inward direction relative to the up-and-down direction towards the front. On the other hand, a front end surface of each of the engagement pawls 41*b* forms an arc surface 41*d* centering on the center line O (the rotational axis). Accordingly, the positional displacement of the rotational movement connecting portion 24 in the forward-rearward direction is avoided when the rotational movement connecting portion 24 contacts the contact wall portion 15 and the arc surfaces 41*d*, while the rotational movement connecting portion 24 is supported to be freely rotatable relative to the contact wall portion 15 and the arc surfaces 41*d*. According to this modified example of the embodiment, the positional displacement of the rotational movement connecting portion 24 in the up-and-down direction is restricted by the arm portions 41*a*, which sandwich the rotational movement connecting portion 24 in the up-and-down direction.

Accordingly, when the rotational movement connecting portion 24 is slidably moved in the forward direction from a position at which the rotational movement connecting portion 24 is located rearwardly of the protruding portions 41, the protruding portions 41, which press-contact with the outer circumferential surfaces of both end portions of the rotational movement connecting portion 24 at the inclined surfaces 41*c*, respectively, are allowed to elastically deform about the corresponding support pillar portions 16 as the fulcrums, so that a distance between the protruding portions 41 at the engagement pawls 41*b* is enlarged in the up-and-down direction, as indicated by a chain-double-dotted line in FIG. 8B. As a result, the rotational movement connecting portion 24 is allowed to move. The protruding portions 41, which are released from the press-contact with the rotational movement connecting portion 24 at the respective inclined surfaces 41*b* in response to the displacement of the rotational movement connecting portion 24, elastically return to the initial positions and restrict the displacement of the rotational movement connecting portion 24 in the rearward direction by means of the engagement pawls 41*b*.

Additionally, a pair of operation input portions 42 is adapted to the frame 11 instead of the operation input portions 18. The operation input portions 42 are formed so as to extend in alignment with the protruding portions 41, respectively, so that the operation input portions 42 are moved in conjunction with the respective protruding portions 41. In this case, the protruding portions 41, which are operated in conjunction with the respective operation input portions 42, are elastically deformed so that the distance between the protruding portions 41 is enlarged in the up-and-down direction in response to an elastic deformation of the operation input portions 42 about the respective support pillar portions 16 as the fulcrums so that a distance between the operation input portions 42 is narrowed in the up-and-down direction, as indicated by the chain-double-dotted line in FIG. 8B. As a result, the restriction on the displacement of the rotational movement connecting portion 24 in the rearward direction by the engagement pawls 41*b* is cleared.

Figure 9A:
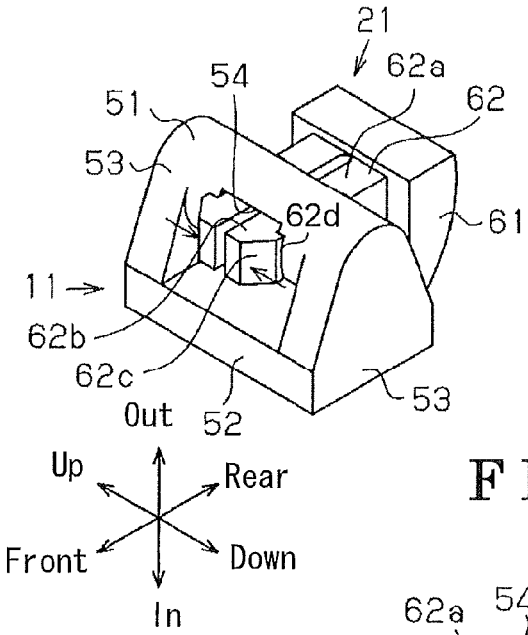
FIG. 9A is a perspective view illustrating a third modified example of the door handle apparatus for the vehicle.
Figure 9B:
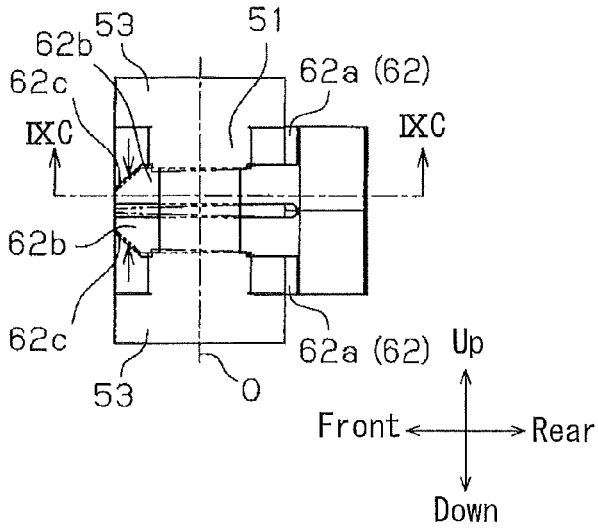
FIG. 9B is a plain view illustrating the third modified example of the door handle apparatus for the vehicle.
Figure 9C:
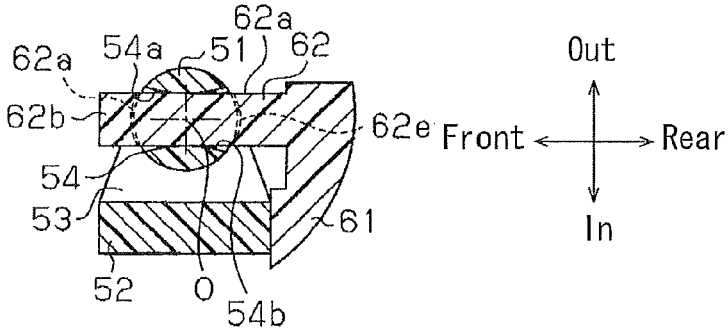
FIG. 9C is a cross-sectional diagram taken along line IXC-IXC in FIG. 9B.

As illustrated in FIGS. 9A, 9B and 9C, a rotational movement connecting portion 51 in a column shape, which is integrally formed at the frame 11, may be adapted to the door handle apparatus 10 instead of the rotational movement connecting portion 24. In other words, a relationship between the rotational movement connecting portion and the protruding portion (the protruding portions), which are provided at the handle 21 and the frame 11, respectively, in the embodiment may be reversed. More specifically, a base wall 52 in a flat plate shape is formed at the front end portion of the frame 11 so as to extend in the up-and-down direction and a pair of support walls 53 in a substantially triangular shape are formed so as to stand towards the vehicle exterior from respective end portions of the base wall 52 in the up-and-down direction. The rotational movement connecting portion 51 is formed on the frame 11 so as to be supported at end portions of the respective support walls 52 in the cantilever manner, so that the center line O of the rotational movement connecting portion 51 extends in the up-and-down direction. An insertion bore 54 in a substantially quadrangle shape is formed at an intermediate portion of the rotational movement connecting portion 51 in a longitudinal direction thereof so as to open to the front and rear. Inner wall surfaces 54*a* and 54*b* of the insertion bore 54 positioned closer to the vehicle exterior and the vehicle interior form circumferential surfaces, respectively, which protrude towards the center line O (see FIG. 9C). On the other hand, a contact wall portion 61 in a half hog-backed shape is formed at the front end portion of the handle 21 (the arm portion 22). More specifically, the contact wall portion 61 is formed so that a thickness thereof gradually decreases in the forward-rearward direction towards the vehicle interior. Furthermore, a pair of protruding portions 62 in an elongated shape is formed so as to extend from a front end surface of the contact wall portion 61 in the forward direction while being spaced away from each other in the up-and-down direction. Each of the protruding portions 62 integrally includes an arm portion 62*a* and an engagement pawl 62*b*. The arm portion 62*a* is supported by the contact wall portion 61 in the cantilever manner and extends in the forward-rearward direction. The engagement pawls 62*b* are formed at front end portions of the arm portions 62*a*, respectively, so as to protrude in a direction opposing each other in the up-and-down direction. Each of the protruding portions 62 is formed so that, for example, the arm portion 62*a* is allowed to be elastically deformable (bent) about the contact wall portion 61 as the fulcrum in a clockwise direction or in a counterclockwise direction in FIG. 9B. Inclined surfaces 62*c* are formed at front end surfaces of the engagement pawls 62*b*, respectively, so that the front end surfaces incline in the up-and-down direction towards the front in an opposite manner. On the other hand, a rear end surface of each of the engagement pawls 62*b* forms an arc surface 62*d* so as to slidably contact an outer circumferential surface of a front end portion of the rotational movement connecting portion 51 positioned in the vicinity of the insertion bore 54. Furthermore, an arc surface 62*e* serving as a contact wall portion, which is positioned so as to face the arc surface 62*d* and slidably contacts the outer circumferential surface of a rear end portion of the rotational movement connecting portion 51 positioned in the vicinity of the insertion bore 54, is formed at an intermediate portion of each of the protruding portions 62 in a longitudinal direction thereof. The protruding portions 62 (the handle 21) are supported by the rotational movement connecting portion 51 while being freely rotatable in a manner where the arc surfaces 62*d* and 62*e* slidably contact the outer circumferential surface of the rotational movement connecting portion 51. Additionally, a rotationally movement range of the protruding portions 62 relative to the rotational movement connecting portion 51 is set so as to correspond to a range of a clearance formed between the inner wall surfaces 54*a* and 54*b*. Accordingly, the rotational movement range of the protruding portions 62 relative to the rotational movement connecting portion 51 is limited to a range until the front end surface of the contact wall portion 61 contacts the rear end surface of the base wall 52.

Accordingly, when the protruding portions 62 are slidably moved in the forward direction from a position rearward of the insertion bore 54 (the rotational movement connecting portion 51) in order to insert the protruding portions 62 into the insertion bore 54, the protruding portions 62, whose inclined surfaces 62*c* press-contact with the upper and lower inner wall surfaces of the insertion bore 54, respectively, are elastically deformed about the contact wall portion 61 so that a distance between the front end portions of the respective protruding portions 62 is narrowed in the up-and-down direction as indicated by arrows in FIG. 9B, thereby allowing the protruding portions 62 to move through the insertion bore 54. Then, the front end surface of the contact wall portion 61 contacts the rear end surface of the base wall 52 in response to the displacement of the protruding portions 62. When the arc surfaces 62*e* contact the outer circumferential surface of the rotational movement connecting portion 51, the displacement of the protruding portions 62 in the forward direction is restricted. Simultaneously, the protruding portions 62, which are released from the press-contact with the respective upper and lower inner wall surfaces of the insertion bore 54 (the rotational movement connecting portion 51) at the inclined surfaces 62*c*, elastically return to the initial positions and restrict the displacement of the rotational movement connecting portion 51 in the rearward direction by means of the engagement pawls 62*b*. Additionally, the displacement of the protruding portions 62 in the up-and-down direction and in the inward-outward direction is restricted by the inner wall surfaces of the insertion bore 54, into which the protruding portions 62 are inserted. Accordingly, the handle 21 is connected to the frame 11 while allowing the handle 21 to rotate relative to the frame 11.

On the other hand, in order to detach the handle 21 from the frame 11, the inclined surfaces 62*c* of the respective protruding portions 62, which protrude towards in the forward direction relative to the insertion bore 54, are pinched so that the protruding portions 62 are elastically deformed about the contact wall portion 61 as the fulcrum so as to narrow the distance between the front end portions of the respective protruding portions 62 in the up-and-down direction, as indicated by the arrows in FIG. 9B. Accordingly, the displacement restriction of the protruding portions 62 in the rearward direction by the engagement pawls 62*b* is cancelled.

The groove portion 15*a* may be modified so as to penetrate the contact wall portion 15 in the forward-rearward direction. A slide direction for assembling the handle 21 to the frame 11 does not necessarily correspond to the forward-rearward direction of the vehicle, as long as the slide direction of the handle 21 corresponds to the longitudinal direction thereof. Therefore, the vehicle door 1, to which the handle 21 is connected, is not limited to a so-called side door, but a back door and the like may be adapted as the vehicle door 1.

Technical ideas conceivable from the above-described embodiment and other examples will be described below. According to the embodiment, the door handle apparatus 10 for the vehicle includes the protruding portion, which is provided at one of the frame and the handle, and the rotational movement connecting portion, which is provided at the other one of the frame and the handle. The protruding portion integrally includes the arm portion, which extends in the longitudinal direction of the handle and which is supported in the cantilever manner, and the engagement pawl, which protrudes along a slide movement trajectory of the rotational movement connecting portion from the end portion of the arm portion.

Accordingly, the protruding portion may be formed so as to integrally include the arm portion and the engagement pawl, thereby simplifying the configuration of the protruding portion. In this case, the protruding portion is formed so as to press-contact with the rotational movement connecting portion at the engagement pawl in order to elastically deform (bend) about a base end portion of the arm portion when the handle is slidably moved in the longitudinal direction thereof, thereby allowing the rotational movement connecting portion to slidably move. Furthermore, the protruding portion elastically returns to the initial position so that the engagement pawl thereof protrudes along a slide movement trajectory of the rotational movement connecting portion when the press-contact between the engagement pawl and the rotational movement connecting portion is cancelled, thereby restricting the slide displacement of the handle in the longitudinal direction thereof and in other directions.

Accordingly, when assembling the handle 21 to the frame 11, the handle 21 is slidably moved in the longitudinal direction thereof, so that the protruding portion (17, 32, 41, 62), which press contacts with the rotational movement connecting portion (24, 51) is elastically deformed so as to allow the handle 21 to be slidably displaced towards one end portion thereof in the longitudinal direction. Furthermore, when the protruding portion (17, 32, 41, 62) is released from the press-contact with the rotational movement connecting portion (24, 51) at the displacement restriction position, at which the displacement of the handle 21 towards the one end portion in the longitudinal direction is restricted by the contact wall portion (15, 31, 61), and is elastically returned to the initial position, the rotational movement connecting portion (24, 51) is supported by the contact wall portion (15, 31, 61) and the protruding portion (17, 32, 41, 62) so as to be relatively rotatable. Accordingly, the handle 21 is assembled to the frame 11 only by slidably moving the handle 21 in one direction (i.e. towards the one end portion thereof in the longitudinal direction). Furthermore, in this case, the slide displacement of the handle 21 towards the one end portion thereof in the longitudinal direction or other directions is restricted by the contact wall portion (15, 31, 61) and the protruding portion (17, 32, 41, 62). Therefore, the positional displacement of the handle 21 towards the one end portion thereof in the longitudinal direction and other directions becomes avoidable. Additionally, because the rotational movement connecting portion (24, 51) is formed at one of the frame 11 and the handle 21 and the contact wall portion (15, 31, 61) and the protruding portion (17, 32, 41, 62) are formed at the other one of the frame 11 and the handle 21, a number of components used for the door handle apparatus 10 and manufacturing hours for manufacturing the door handle apparatus 10 may be reduced, which may further result in reduction of manufacturing costs of the door handle apparatus 10.

According to the embodiment and modified examples, the door handle apparatus 10 further includes the operation input portion (18, 33, 42), which is integrally formed either at the frame 11 or the handle 21 having the protruding portion (17, 32, 41) and transmits the operation force for canceling the slide movement restriction of the handle 21 towards the other end portion thereof in the longitudinal direction to the protruding portion (17, 32, 41) in response to the press operation inputted to the operation input portion (18, 33, 42).

Accordingly, the operation force for releasing the slide displacement restriction of the handle 21 towards the other side in the longitudinal direction is transmitted to the protruding portion (17, 32, 41) in response to a press operation to the operation input portion (18, 33, 42). Therefore, the handle 21 is easily detached from the frame 11 only by operating the operation input portion (18, 33, 42) in one direction.

According to the embodiment, the end portion of the frame 11 serving as the rotational center of the handle 21 is formed so as to recess and protrude only in one direction facing the handle 21.

Accordingly, the end portion of the frame 11, which serves as the rotational center of the handle 21, is formed so as to recess and protrude only in one direction so as to face the handle 21. Therefore, for example, in the case where the frame 11 is formed by molding, the frame 11 may be formed by using only the pair of dies (the upper and lower dies), which are formed to as to open in the direction corresponding to the one direction when mating together. Accordingly, the shape of the dies for forming the frame 11 may be simplified, which may further result in reducing the manufacturing costs of the door handle apparatus 10.

According to the embodiment, the rotational movement connecting portion 24 is provided at the handle 21 and includes the projection 25, which protrudes from the outer circumferential portion of the rotational movement connecting portion 24 and engages with the frame 11 so as to restrict the positional displacement of the rotational movement connecting portion 24 in the direction extending along the center line O.

Accordingly, the positional displacement of the handle 21 in the direction extending along the center line O of the rotational movement connecting portion 24 is restricted in a manner where the projection 25, which is formed at the rotational movement connecting portion 24 so as to protrude from the outer circumferential portion thereof, engages with the frame 11. As a result, the positional displacement of the handle 21 in the direction extending along the center line O in the vicinity of the rotational axis (the rotational movement connecting portion 24) becomes avoidable.

According to the embodiment and modified examples, the frame 11 includes the wall portion 14 extending from the contact wall portion (15, 31) in the longitudinal direction of the handle 21. The protruding portion (17, 41) includes the arm portion (17*a*, 41*a*) extending in the longitudinal direction of the handle 21 and the engagement pawl (17*b*, 41*b*) protruding towards the wall portion 14 from an end portion of the arm portion (17*a*, 41*a*) positioned closer to the other end portion of the handle 21 in the longitudinal direction. The rotational movement connecting portion 24 is avoided from being displaced in the protruding direction of the engagement pawl (17*b*, 41*b*) by means of the wall portion 14 and the arm portion (17*a*, 41).

Accordingly, the positional displacement of the handle 21 and the positional displacement of the rotational movement connecting portion 24 in all directions (i.e. in the longitudinal direction of the handle 21, in the direction extending along the center line of the rotational movement connecting portion, in the protruding direction of the engagement pawl) are avoided while not interfering with the rotational movement of the rotational movement connecting portion 24.

Accordingly, the door handle apparatus 10 for the vehicle appropriately avoids a backlash of the handle 21 relative to the frame 11 in the longitudinal direction while avoiding an increase in the number of components used for the door handle apparatus 10 and the manufacturing hours for manufacturing the door handle apparatus 10.

The principles, preferred embodiment and mode of operation of this disclosure have been described in the foregoing specification. However, the disclosure which is intended to be protected is not to be construed as limited to the particular embodiments disclosed. Further, the embodiments described herein are to be regarded as illustrative rather than restrictive. Variations and changes may be made by others, and equivalents employed, without departing from the spirit of the disclosure. Accordingly, it is expressly intended that all such variations, changes and equivalents which fall within the spirit and scope of the disclosure as defined in the claims, be embraced thereby.

The invention claimed is:

1. A door handle apparatus for a vehicle, comprising:

a frame adapted to be fixed at a door panel of a vehicle door;

a handle adapted so as to be supported by the frame while being freely rotatable relative to the frame, to serve as a holding portion when the vehicle door is operated to open, and so as to transmit an operation force for canceling a retention of the vehicle door to a door lock mechanism, which retains the vehicle door at a fully-closed state, in response to a rotational operation of the handle;

a rotational movement connecting portion integrally formed at the handle and having a center line extending along a rotational axis of the handle;

a contact wall portion integrally formed at the frame and restricting a displacement of the handle towards one end portion thereof in a longitudinal direction thereof in a manner where the contact wall portion contacts the rotational movement connecting portion in response to a slide movement of the handle towards the one end portion thereof in the longitudinal direction; and a protruding portion integrally formed at the frame, being elastically deformable when the protruding portion press-contacts the rotational movement connecting portion in response to the slide movement of the handle towards the one end portion thereof in the longitudinal direction so as to allow the handle to be slidably displaced towards the one end portion thereof in the longitudinal direction, elastically returning to an initial position so as to restrict the slide displacement of the handle towards the other end portion thereof in the longitudinal direction when a press-contact against the rotational movement connecting portion is cancelled while the rotational movement connecting portion is positioned at a movement restriction position for restricting the displacement of the handle towards the one end portion thereof in the longitudinal direction by means of the contact wall portion, and supporting the rotational movement connecting portion in conjunction with the contact wall portion while allowing the rotational movement connecting portion to be freely rotatable relative to the contact wall portion and the protruding portion; and an operation input portion integrally formed at the frame and transmitting the operation force for canceling a slide movement restriction of the handle towards the other end portion thereof in the longitudinal direction to the protruding portion in response to a press operation inputted to the operation input portion.

2. The door handle apparatus for the vehicle according to claim 1, wherein an end portion of the frame serving as a rotational center of the handle is formed so as to recess and protrude only in one direction facing the handle.

3. The door handle apparatus for the vehicle according to claim 1, wherein the rotational movement connecting portion is provided at the handle and includes a projection, which protrudes from an outer circumferential portion of the rotational movement connecting portion and engages with the frame so as to restrict a positional displacement of the rotational movement connecting portion in the direction extending along the center line.

4. The door handle apparatus for the vehicle according to claim 3, wherein the frame includes a wall portion extending from the contact wall portion in the longitudinal direction of the handle, the protruding portion includes an arm portion extending in the longitudinal direction of the handle and an engagement pawl protruding towards the wall portion from an end portion of the arm portion positioned closer to the other end portion of the handle in the longitudinal direction, and the rotational movement connecting portion is avoided from being displaced in a protruding direction of the engagement pawl by means of the wall portion and the arm portion.

5. A door handle apparatus for a vehicle, comprising:

a frame adapted to be fixed at a door panel of a vehicle door;

a handle adapted so as to be supported by the frame while being freely rotatable relative to the frame, to serve as a holding portion when the vehicle door is operated to open, and so as to transmit an operation force for canceling a retention of the vehicle door to a door lock mechanism, which retains the vehicle door at a fully-closed state, in response to a rotational operation of the handle;

a rotational movement connecting portion integrally formed at the handle and having a center line extending along a rotational axis of the handle;

a contact wall portion integrally formed at the frame and restricting a displacement of the handle towards one end portion thereof in a longitudinal direction thereof in a manner where the contact wall portion contacts the rotational movement connecting portion in response to a slide movement of the handle towards the one end portion thereof in the longitudinal direction;

a protruding portion integrally formed at the frame, being elastically deformable when the protruding portion press-contacts the rotational movement connecting portion in response to the slide movement of the handle towards the one end portion thereof in the longitudinal direction so as to allow the handle to be slidably displaced towards the one end portion thereof in the longitudinal direction, elastically returning to an initial position so as to restrict the slide displacement of the handle towards the other end portion thereof in the longitudinal direction when a press-contact against the rotational movement connecting portion is cancelled while the rotational movement connecting portion is positioned at a movement restriction position for restricting the displacement of the handle towards the one end portion thereof in the longitudinal direction by means of the contact wall portion, and supporting the rotational movement connecting portion in conjunction with the contact wall portion while allowing the rotational movement connecting portion to be freely rotatable relative to the contact wall portion and the protruding portion;

a support pillar portion integrally formed at the frame and serving as a fulcrum of the protruding portion when being elastically deformed; and an operation input portion integrally formed at the frame and elastically deforming the protruding portion about the support pillar portion as the fulcrum in response to a press operation applied to the operation input portion.

6. The door handle apparatus for the vehicle according to claim 5, wherein an end portion of the frame serving as a rotational center of the handle is formed so as to recess and protrude only in a direction facing the handle.

7. The door handle apparatus for the vehicle according to claim 5, wherein the rotational movement connecting portion is provided at the handle and includes a projection, which protrudes from an outer circumferential portion of the rotational movement connecting portion and engages with the frame so as to restricts a positional displacement of the rotational movement connecting portion in the direction extending along the center line thereof.

8. The door handle apparatus for the vehicle according to claim 6, wherein the rotational movement connecting portion is provided at the handle and includes a projection, which protrudes from an outer circumferential portion of the rotational movement connecting portion and engages with the frame so as to restricts a positional displacement of the rotational movement connecting portion in the direction extending along the center line thereof.

9. The door handle apparatus for the vehicle according to claim 7, wherein the frame includes a wall portion extending from the contact wall portion in the longitudinal direction of the handle, the protruding portion includes an arm portion extending in the longitudinal direction of the handle and an engagement pawl protruding from an end portion of the arm portion positioned closer to the other end portion of the handle in the longitudinal direction towards the wall portion, and the rotational movement connecting portion is avoided from being displaced in a protruding direction of the engagement pawl by means of the wall portion and the arm portion.

10. The door handle apparatus for the vehicle according to claim 8, wherein the frame includes a wall portion extending from the contact wall portion in the longitudinal direction of the handle, the protruding portion includes an arm portion extending in the longitudinal direction of the handle and an engagement pawl protruding from an end portion of the arm portion positioned closer to the other end portion of the handle in the longitudinal direction towards the wall portion, and the rotational movement connecting portion is avoided from being displaced in a protruding direction of the engagement pawl by means of the wall portion and the arm portion.

* * * * *